US006435701B1

(12) United States Patent
Chen

(10) Patent No.: US 6,435,701 B1
(45) Date of Patent: Aug. 20, 2002

(54) ENCLOSING / SNAPPING-TYPE INLAID LIGHT

(75) Inventor: Yvonne Chen, Hsi Chih (TW)

(73) Assignee: Kai-ee Co., Ltd., Taipei Hsien (TW)

( * ) Notice: Subject to any disclaimer, the term of this patent is extended or adjusted under 35 U.S.C. 154(b) by 0 days.

(21) Appl. No.: 09/742,417

(22) Filed: Dec. 22, 2000

(51) Int. Cl.[7] ..... F21V 11/00
(52) U.S. Cl. ..... 362/368; 362/147; 362/217
(58) Field of Search ..... 362/370, 368, 362/147, 148, 223, 217, 260, 311

(56) References Cited

U.S. PATENT DOCUMENTS 5,171,085 A 12/1992 Jaksich 6,139,169 A * 10/2000 Cafero ..... 362/291

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

Enclosing/snapping-type inlaid light including a base seat fixed on a fixing face, at least one lamp tube being, bridged between left and right ends of the base seat and mounted in the base seat. There are two end caps fixed at two ends of the base seat respectively, two sides of each of the end caps being respectively formed with opposite recessed snap sections. Multiple support legs fixed under a pan section of the base seat. A diffuser, a front and a rear sides of the diffuser being respectively formed with flanges which are enclosed in and snapped by the snap sections of the end caps, whereby the diffuser is firmly transversely bridged between the bottom ends of the two end caps.

5 Claims, 7 Drawing Sheets

ENCLOSING / SNAPPING-TYPE INLAID LIGHT

BACKGROUND OF THE INVENTION

1. Field of the Invention

The present invention is related to an enclosing/snapping-type inlaid light in which two sides of the diffuser are respectively formed with flanges which are enclosed in and snapped by the snap sections of two end caps, whereby the diffuser is firmly bridged between the end caps.

2. Description of the Prior Art

A conventional light applied to vehicles such as yacht, ferry, bus, train, etc. includes a lamp seat lockable on a fixing face of the light. At least one lamp tube is transversely mounted in the lamp seat. In addition, relevant electronic elements are arranged in the lamp seat for controlling turning on/off of the lamp tube. A diffuser is locked at bottom end of the lamp seat by screws to enclose the electronic elements and the lamp tube. In the case that the lamp tube is damaged and needs to be replaced, it is necessary to untighten the screws one by one for taking off the diffuser and replacing the lamp tube. Such procedure is quite troublesome. Moreover, the vehicle on which the light is installed is always subject to shocking. As a result, the screws for locking the diffuser with the lamp seat are liable to loosen.

U.S. Pat. No. 5,171,085 discloses a lighting fixture to improve the conventional light. The lighting fixture includes a housing 11. Two end caps 21, 22 are connected with two ends of the housing 11. Stud pins 25 are disposed on two sides of the end caps 21, 22. The stud pins 25 are stopped by and latched in the grooves 29 formed on two sides of the diffuser 27. The end caps 21, 22 are plastic-made and formed with snap teeth 50 latched in the windows 32 of the housing 11. After the light has been turned on for a long time, the temperature often leads to hardening or even cracking of the plastic-made end caps 21, 22. As a result, it will be impossible to further tightly latch the housing 11 with the end caps 21, 22. In addition, the fine stud pins 25 of the end caps 21, 22 often are subject to breakage due to concentration of the stress. This shortens using life of the lighting.

SUMMARY OF THE INVENTION

It is therefore a primary object of the present invention to provide an enclosing/snapping-type inlaid light including:

a base seat including a pan section and two side walls downward projecting from front and rear sides of the pan section, bottom edges of the side walls turning outward to form mounting flanges, the pan section and the mounting flanges being respectively formed with multiple fixing holes, whereby screws or rivets are passed through the fixing holes for tightly fixing the base seat on a fixing face, a left and a right ends of the pan section being respectively formed with downward extending end boards, at least one set of lamp seats being oppositely mounted on inner sides of the end boards for mounting at least one lamp tube between the lamp seats;

two end caps fixed at two ends of the base seat, two sides of each of the end caps being respectively formed with opposite recessed snap sections;

multiple support legs fixed on lower side of the pan section of the base seat;

a protective rack bridged between bottom ends of the support legs, the protective rack and the base seat defining therebetween a receiving space in which electronic elements such as circuit boards are installed; and a diffuser, a front and a rear sides of the diffuser being respectively formed with flanges which are enclosed in and snapped by the snap sections of the end caps, whereby the diffuser is firmly transversely bridged between the bottom ends of the two end caps.

The present invention can be best understood through the following description and accompanying drawings wherein:

DETAILED DESCRIPTION OF THE PREFERRED EMBODIMENTS

Figure 1:
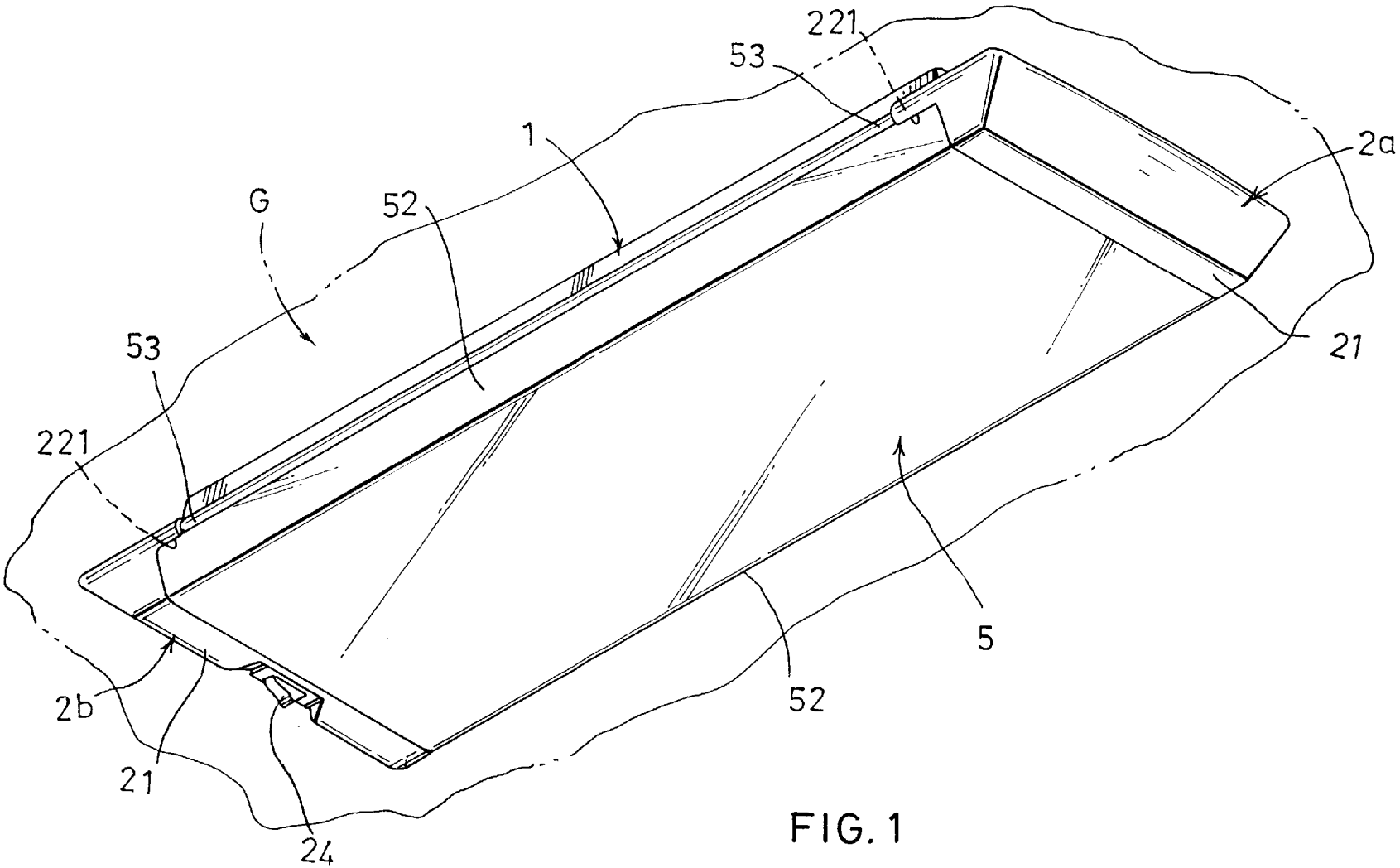
FIG. 1 is a perspective view of the present invention.

Please refer to FIGS. 1 to 10. The enclosing/snapping-type inlaid light of the present invention includes: a base seat 1 fixed on a fixing face G of a ship, a bus, etc.; at least one lamp tube 18 bridged over and mounted in the base seat 1; two end caps 2*a*, 2*b* fixed at two ends of the base seat 1, two sides of each of the end caps 2*a*, 2*b* being respectively formed with opposite recessed snap sections 221; multiple support legs 3 fixed at bottom end of the base seat 1; a protective rack 4 bridged between the bottom ends of the support legs 3, the protective rack 4 and the base seat 1 defining therebetween a receiving space 40 in which the electronic elements E such as circuit boards are installed; and a diffuser 5. The front and rear sides of the diffuser 5 are respectively formed with flanges 53 which are enclosed in and snapped by the snap sections 221 of the end caps 2*a*, 2*b*. The diffuser 5 is bridged between the bottom ends of the two end caps 2*a*, 2*b*.

Figure 3:
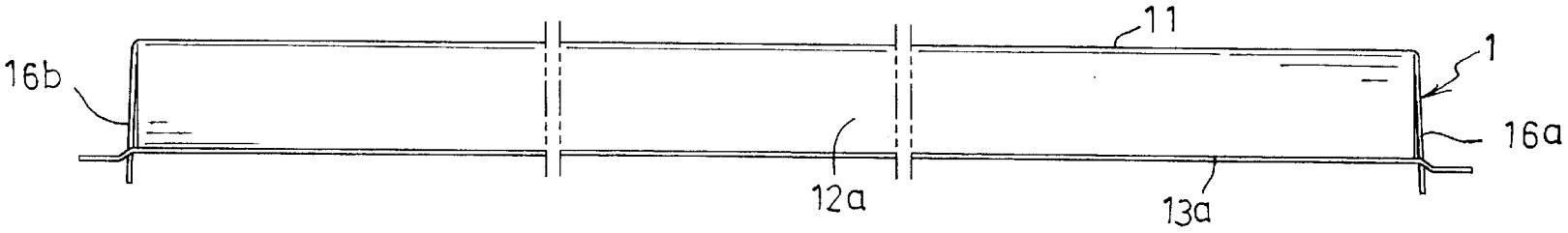
FIG. 3 is a front view of the base seat of the present invention.
Figure 2:
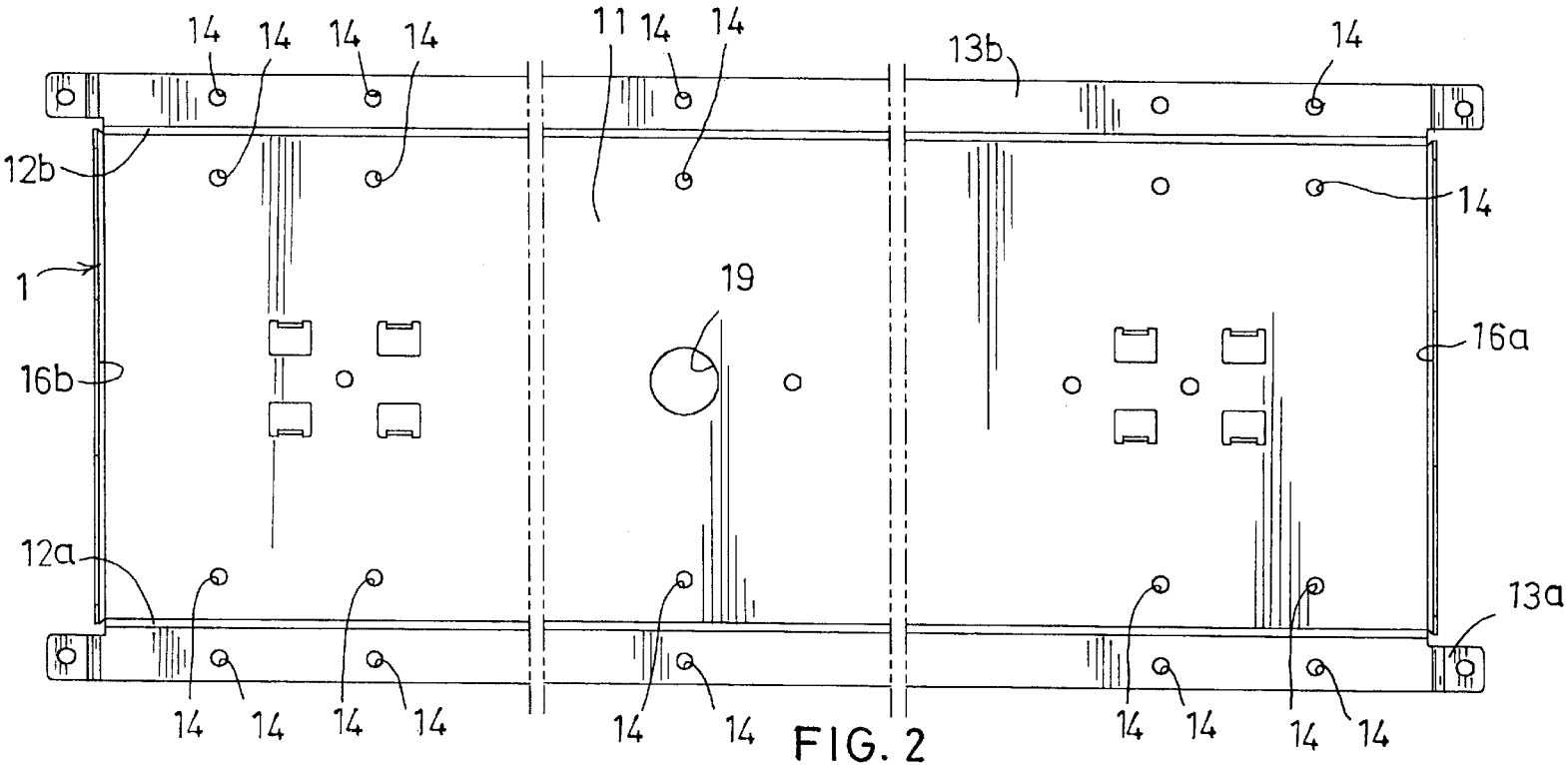
FIG. 2 is a plane view of the base seat of the present invention.
Figure 5:
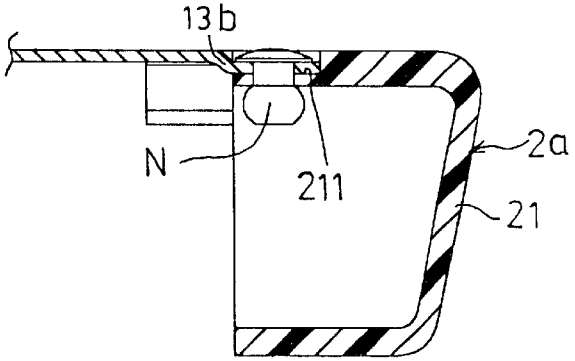
FIG. 5 is a partially sectional view taken along line 5—5 of FIG. 4.

Please refer to FIGS. 1, 2 and 3. The base seat 1 of the present invention is made of a metal sheet by integral punching. The base seat 1 includes a pan section 11 and two side walls 12*a*, 12*b* downward projecting from front and rear sides of the pan section 11. The bottom edges of the side walls 12*a*, 12*b* turn outward to form mounting flanges 13*a*, 13*b*. The pan section 11 and the mounting flanges 13*a*, 13*b* are respectively formed with multiple fixing holes 14. Screws or rivets are passed through the fixing holes 14 for tightly fixing the base seat 1 on a fixing face G. The left and right ends of the pan section 11 are respectively formed with downward extending end boards 16*a*, 16*b*. At least one set of lamp seats 17*a*, 17*b* are oppositely mounted on inner sides of the end boards 16*a*, 16*b*. At least one lamp tube 18 is mounted and bridged between the opposite lamp seats 17*a*, 17*b*.

The pan section 11 of the base seat 1 is formed with a wire hole 19. A wire protective ring 191 is fitted on the circumference of the wire hole 19, whereby a wire can be conducted from external side through the wire hole 19 into the light.

Referring to FIGS. 4 to 7, each of the end caps 2*a*, 2*b* has a main body 21 on which a platform 211 is defined for overlying the ends of the mounting flanges 13*a*, 13*b* of the base seat 1. The main body 21 is tightly fixed with the mounting flanges 13*a*, 13*b* by rivets N. The front and rear sides of the main body 21 are respectively formed with two snap arms 22. The inner sides of the snap arms 22 are formed with opposite recessed snap sections 221 for enclosing and snapping the flanges 53 of the diffuser 5. One end cap 2*b* is formed with a window 23 in which a switch 24 is inlaid for controlling the turning on/off of the light.

Figure 6:
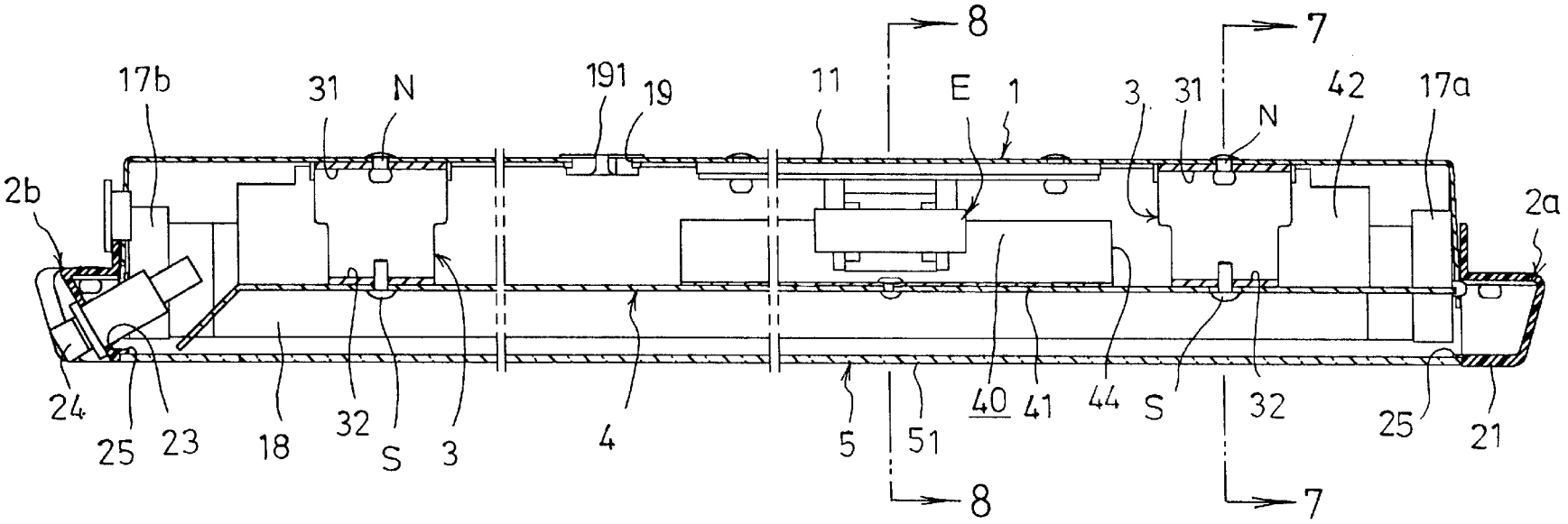
FIG. 6 is a partially sectional view taken along line 6—6 of FIG. 4.
Figure 7:
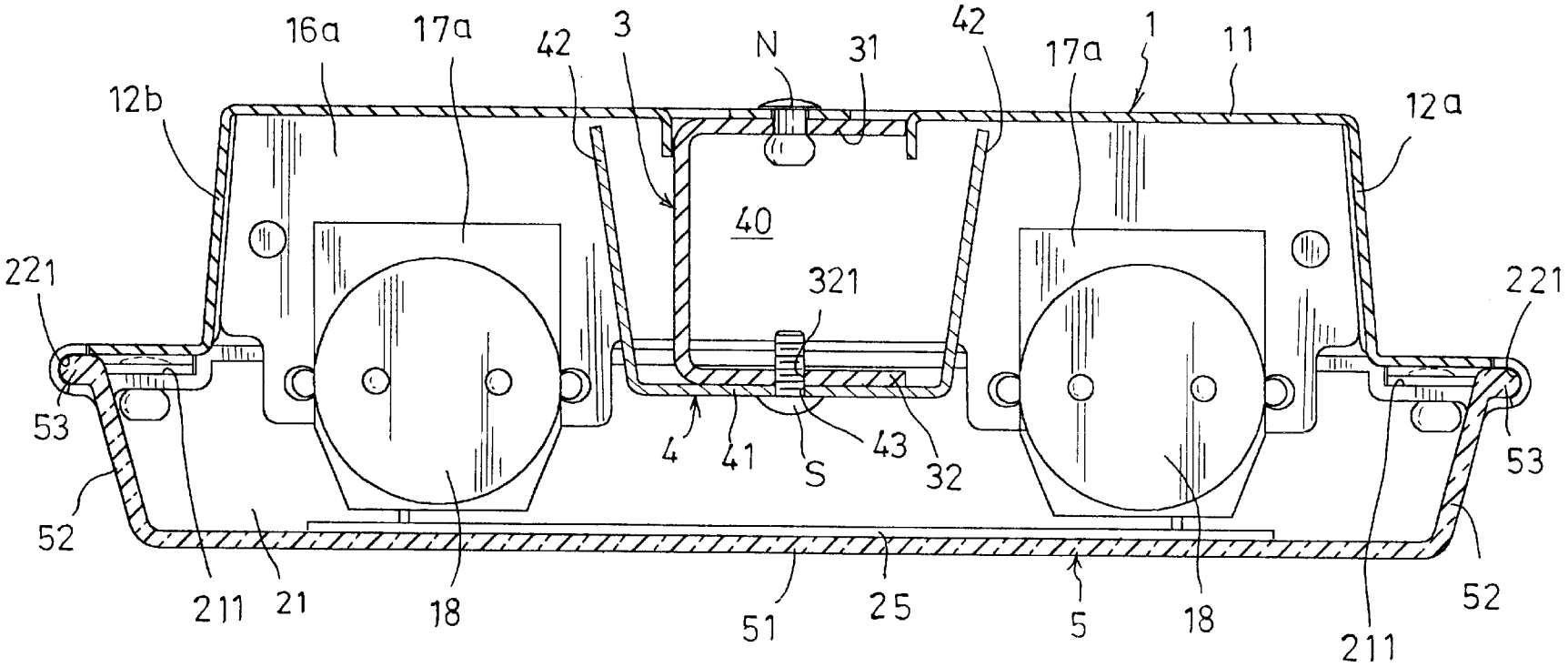
FIG. 7 is a partially sectional view taken along line 7—7 of FIG. 6.
Figure 8:
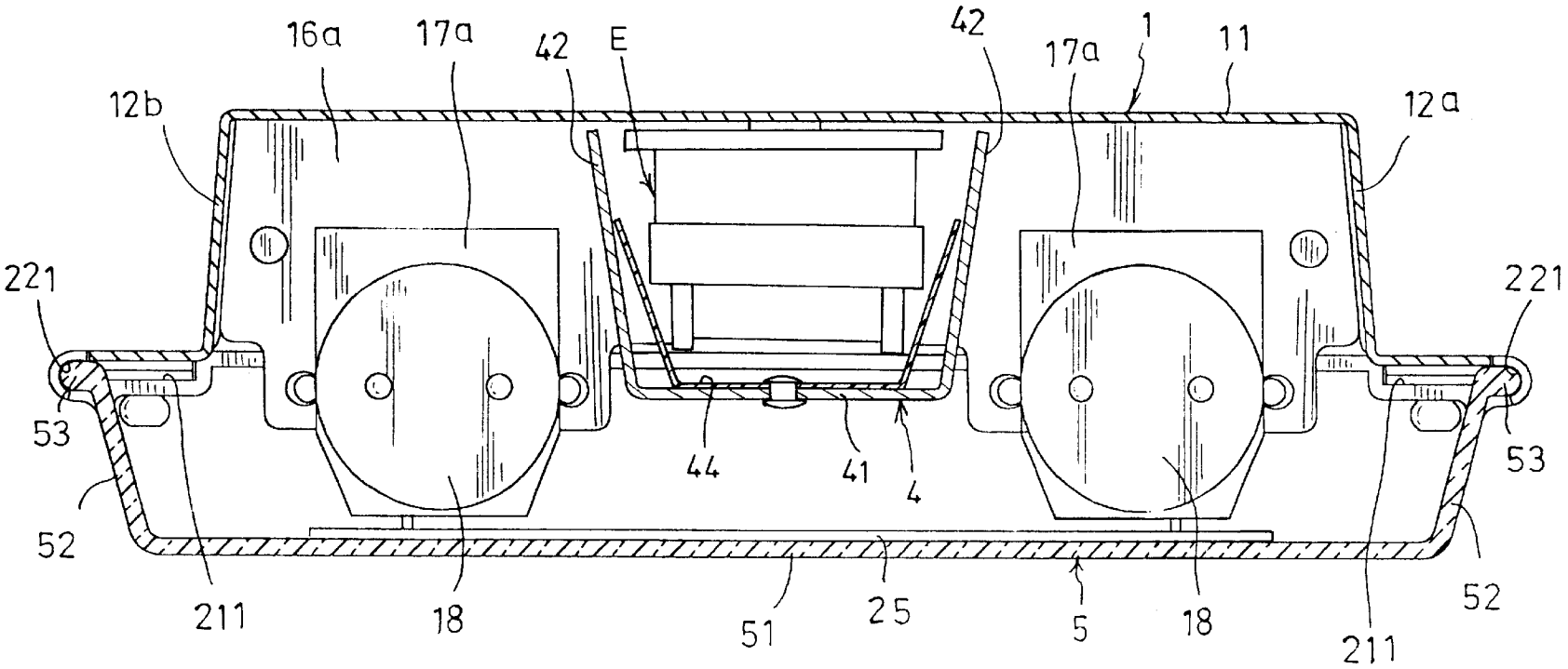
FIG. 8 is a partially sectional view taken along line 8—8 of FIG. 6.

Referring to FIGS. 6 and 7, the support leg 3 is C-shaped. The top board section 31 of the support leg 3 underlies the pan section 11 of the base seat 1 and is tightly locked therewith by rivets. The bottom board section 32 of the support leg 3 is formed with a fixing hole 321. A screw S is screwed into the fixing hole 321 for locking the protective rack 4. The support leg 3 can be alternatively formed with a rectangular cross-section or otherwise shaped cross-section.

Figure 4:
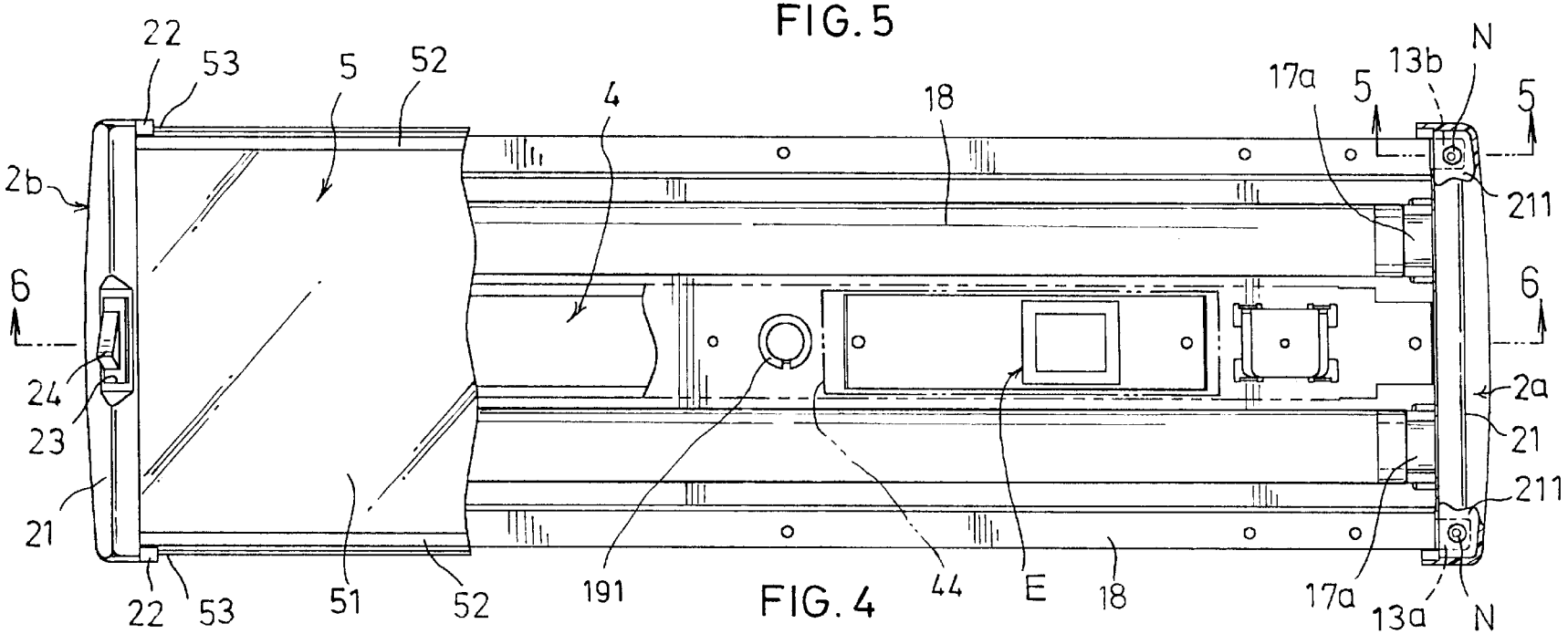
FIG. 4 is a bottom view of the present invention, showing the structure thereof.

Please refer to FIGS. 4, 6 and 7. The protective rack 4 of the present invention includes a panel body 41 having two side walls 42 respectively upward extending from two sides of the panel body 41. The panel body 41 is formed with multiple through holes 43. Screws S are passed through the through holes 43 and screwed into the fixing holes 321 of the support legs 3 so that the protective rack 4 is bridged between and locked at the bottom ends of the support legs 3. The protective rack 4 and the base seat 1 define therebetween a receiving space 40 in which the electronic elements E such as circuit boards, relays, etc. are received without being exposed to outer side. The protective rack 4 achieves a beautified appearance and prevents the electronic elements from being incautiously touched or pulled during replacement or service.

The present invention further includes an insulating cover 44 fixedly connected with upper side of the panel body 41 of the protective rack 4. The insulating cover 44 shields the electronic elements E and isolates power from the protective rack 4.

The diffuser 5 of the present invention is made of a transparent material, including a face board 51. Two ends of the face board 51 underlie stop plates 25 of the two end caps 2*a*, 2*b*. Two slope boards 52 respectively upward and outward extend from two sides of the face board 51. The end edge of the slope board 52 is formed with a flange 53 which is snapped in the snap section 221 of the end cap 2*a*, 2*b*. Therefore, the diffuser 5 can be stably connected between the two end caps 2*a*, 2*b* under the lamp tube 18 mounted in the base seat 1.

The end caps 2*a*, 2*b* are tightly fixed at two ends of the base seat 1 by rivets N. Therefor, even if the light mounted on a ship or vehicle is subject to shocking for a long time, the end caps 2*a*, 2*b* will be still firmly connected with the base seat 1 without loosening. Moreover, when it is desired to replace the lamp tube 18 in the light, a user only needs to slightly compress the slope boards 52 on two sides of the diffuser 4 and oppositely contract the slope boards 52. At this time, the flanges 53 of top ends of the slope boards 52 are unlatched from the snap sections 221 of the snap arms 22 of the end caps and then the diffuser 4 can be easily detached for replacing the lamp tube 18. After the lamp tube 18 is replaced, by the same way, the slope boards 52 are slightly pressed toward each other to make the flanges 53 resiliently snapped into the snap sections 221 of the snap arms 22. At this time, the flanges 53 are firmly enclosed in and snapped by the snap sections 221 to assemble the diffuser 5 with the base seat 1. Therefore, during the replacement of the lamp tube 18, it is unnecessary to untighten any screw and the replacement can be conveniently and quickly performed.

The snap arms 22 respectively outward extend from two lateral edges of the end caps 2*a*, 2*b* and are formed with recessed snap sections 221. Therefore, the stress concentrated on the snap arms 22 and the main bodies 21 of the end caps 2*a*, 2*b* can be reduced so that the snap arms 22 are protected from being broken and the using life is prolonged.

Figure 9:
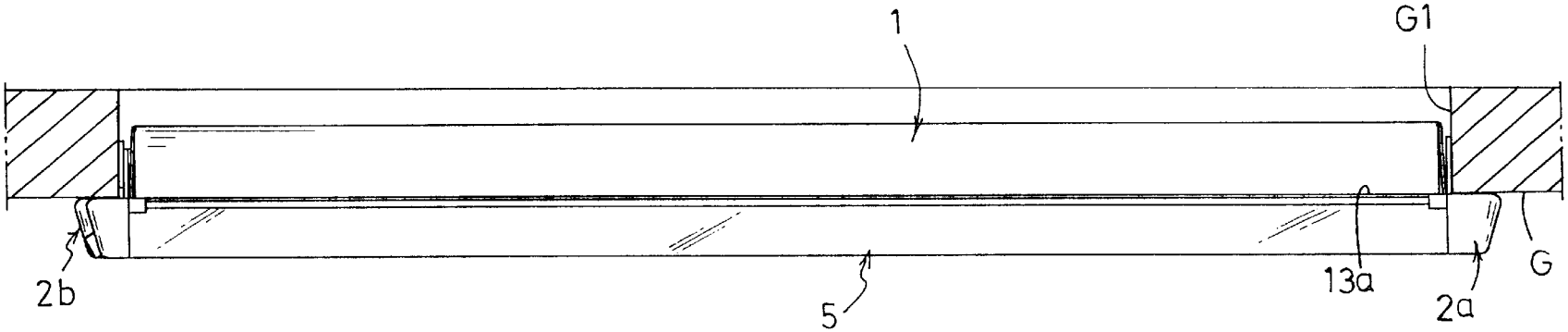
FIG. 9 shows that the present invention is used as an inlaid light.
Figure 10:
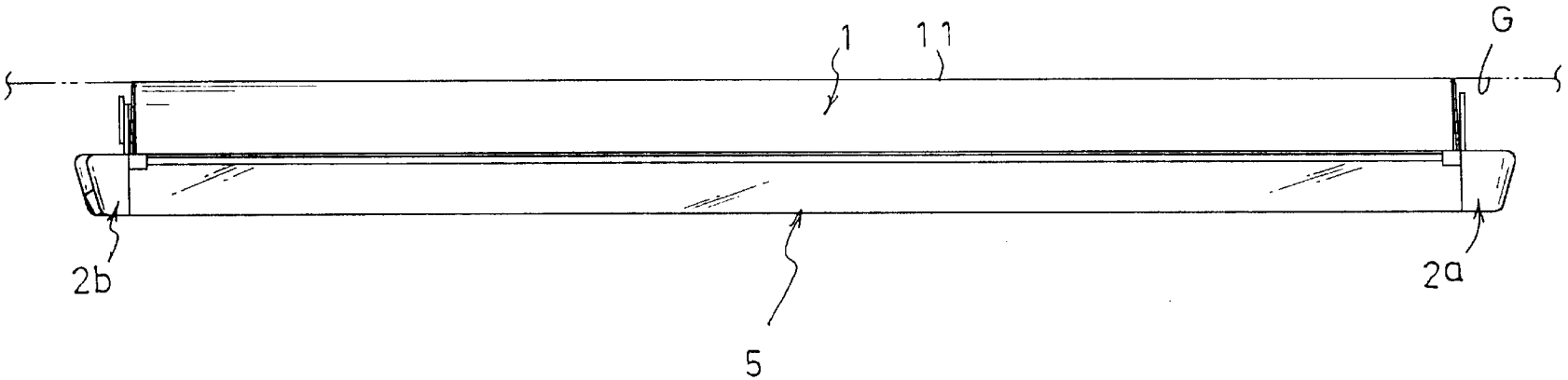
FIG. 10 shows that the present invention is. used as a ceiling light.

Please refer to FIGS. 2 and 9. The pan section 11 and the mounting flanges 13*a*, 13*b* of the base seat 1 are respectively formed with multiple fixing holes 14. Therefore, the base seat 1 can be firmly inlaid in an insertion cavity G1 of the fixing face G with the mounting flanges 13*a*, 13*b* overlying outer periphery of the insertion cavity G1. Screws or rivets are passed through the fixing holes 14 of the mounting flanges 13*a*, 13*b* to tighten the-base seat 1 on the fixing face G. The top face of the diffuser 4 is proximal to the fixing face G to form the inlaid light. Alternatively, as shown in FIGS. 2 and 10, the pan section 11 of the base seat 1 is attached to lower side of the fixing face G and screws or rivets are passed through the fixing holes 14 of the pan section 11 to tighten the base seat 1 on the fixing face G. Under such circumstance, the top face of the diffuser 4 is spaced from the fixing face G by a certain distance to form a ceiling light for use in a different site.

The above embodiments are only used to illustrate the present invention, not intended to limit the scope thereof. Many modifications of the above embodiments can be made without departing from the spirit of the present invention.

What is claimed is:

1. Enclosing/snapping-type inlaid light comprising:

a base seat including a pan section and two side walls downward projecting from front and rear sides of the pan section, bottom edges of the side walls turning outward to form mounting flanges, the pan section and the mounting flanges being respectively formed with multiple fixing holes, whereby screws or rivets are passed through the fixing holes for tightly fixing the base seat on a fixing face, a left and a right ends of the pan section being respectively formed with downward extending end boards, at least one set of lamp seats being oppositely mounted on inner sides of the end boards for mounting at least one lamp tube between the lamp seats;

two end caps fixed at two ends of the base seat, two sides of each of the end caps being respectively formed with opposite recessed snap sections;

multiple support legs fixed on lower side of the pan section of the base seat, at least one of said support legs being C-shaped in contour defining a top board section and a bottom board section, said top board section underlying said pan section of said base seat and fixedly coupled thereto;

a protective rack bridged between bottom ends of the support legs, the protective rack and the base seat defining therebetween a receiving space in which electronic elements such as circuit boards are installed, said bottom board section of said support legs being threadedly coupled to said protective rack for forming said receiving space; and a diffuser, a front and a rear sides of the diffuser being respectively formed with flanges which are enclosed in and snapped by the snap sections of the end caps, whereby the diffuser is firmly transversely bridged between the bottom ends of the two end caps, said diffuser including a face board having a pair of opposing ends underlying a pair of stop plates of said end caps, said diffuser further including a pair of slope boards formed integrally with said face board and extending in an inclined manner outwardly and upwardly, each of said slope boards having a flange which is secured within said snap sections of a respective end cap whereby said slope boards are compressed for removal of said diffuser from said snap sections of said end caps.

2. Enclosing/snapping-type inlaid light as claimed in claim 1, wherein each end cap has a main body on which a platform is defined for overlying the mounting flanges of the base seat, the main body being tightly fixed with the mounting flanges by rivets, a front and a rear sides of the main body being respectively formed with two snap arms, inner sides of the snap arms being formed with opposite recessed snap sections for enclosing and snapping the flanges of the diffuser, one of the end caps being formed with a window in which a switch is inlaid for controlling the turning on/off of the light.

3. Enclosing/snapping-type inlaid light as claimed in claim 1, wherein the pan section of the base seat is formed with a wire hole, a wire protective ring being fitted on the circumference of the wire hole, whereby a wire can be conducted from external side through the wire hole into the light.

4. Enclosing/snapping-type inlaid light as claimed in claim 1, wherein the protective rack includes a panel body having two side walls respectively upward extending from two sides of the panel body, the panel body being formed with multiple through holes, the protective rack and the base seat defining therebetween a receiving space in which electronic elements are mounted.

5. Enclosing/snapping-type inlaid light as claimed in claim 1, further comprising an insulating cover fixedly connected with upper side of the panel body of the protective rack, the insulating cover shielding the electronic elements and isolating power from the protective rack.

* * * * *